US007350243B2

(12) United States Patent
Zahuranec

(10) Patent No.: US 7,350,243 B2
(45) Date of Patent: Apr. 1, 2008

(54) CLOSET FLANGE WITH KNOCKOUT

(75) Inventor: Terry L. Zahuranec, North Olmsted, OH (US)

(73) Assignee: Oatey Co., Cleveland, OH (US)

( * ) Notice: Subject to any disclaimer, the term of this patent is extended or adjusted under 35 U.S.C. 154(b) by 0 days.

(21) Appl. No.: 11/614,205

(22) Filed: Dec. 21, 2006

(65) Prior Publication Data

US 2007/0226884 A1 Oct. 4, 2007

Related U.S. Application Data

(60) Provisional application No. 60/788,484, filed on Mar. 31, 2006.

(51) Int. Cl.
*E03D 11/16* (2006.01)
*E03D 11/14* (2006.01)

(52) U.S. Cl. ..... 4/252.4; 4/252.1

(58) Field of Classification Search ..... 4/252.1–252.6; 285/3

See application file for complete search history.

(56) References Cited

U.S. PATENT DOCUMENTS

| | | | | |
|---|---|---|---|---|
| 2,596,182 | A * | 5/1952 | Sosaya | 285/3 |
| 4,827,539 | A | 5/1989 | Kiziah | |
| 5,377,361 | A * | 1/1995 | Piskula | 4/252.4 |
| 7,055,184 | B2 * | 6/2006 | Humber | 4/252.4 |
| 2005/0138722 | A1 * | 6/2005 | Humber | 4/252.1 |

* cited by examiner

*Primary Examiner*—Gregory L. Huson
*Assistant Examiner*—Kristie A. Mahone
(74) *Attorney, Agent, or Firm*—Renner, Otto, Boisselle & Sklar, LLP

(57) ABSTRACT

A closet flange includes a body having a lower body portion containing a bore and an upper body portion containing an inlet opening in fluid communication with the bore. Within the body is a knockout for closing off the bore. The knockout has a frangible connection with an interior wall of the body and one or more portions that extend radially outwardly into a portion of the inlet opening that has a larger diameter than the bore to permit the knockout to be broken out of the body while preventing the knockout from passing all the way through the bore.

20 Claims, 3 Drawing Sheets

CLOSET FLANGE WITH KNOCKOUT

CROSS-REFERENCE TO RELATED APPLICATIONS

This application claims the benefit of U.S. Provisional Application No. 60/788,484, filed Mar. 31, 2006.

FIELD OF THE INVENTION

This invention relates to a closet flange used for installing a toilet and connecting it to a plumbing system. The toilet flange incorporates a knockout that is removable after pressure testing of the plumbing system has been completed.

BACKGROUND OF THE INVENTION

Building codes require pressure testing points of a plumbing system for leaks and proper connection. Often piping components such as closet flanges will have an integral test cap for this test. After the test, the test cap needs to be carefully removed to ensure that it does not pass through the closet flange into the sewer system and cause blockage problems.

SUMMARY OF THE INVENTION

The closet flange of the present invention includes a body having a lower body portion containing a bore and an upper body portion containing an inlet opening communicating with the bore. The inlet opening has a larger diameter than the bore. A knockout is recessed within the body for closing off the bore to permit pressure testing of the plumbing system for leaks and proper connection. The knockout has a frangible connection with the bore to permit the knockout to be broken out of the bore after the pressure testing has been completed. One or more vertical uprights extend upwardly from the knockout within the inlet opening to provide support for one or more protrusions that extend radially outwardly beyond the bore in spaced relation from an interior wall of the inlet opening to prevent the knockout from accidentally passing all the way through the bore as it is being broken out of the bore.

BRIEF DESCRIPTION OF THE DRAWINGS

The present invention may be more readily understood by reference to the following drawings in which.

DETAILED DESCRIPTION

Figure 1:
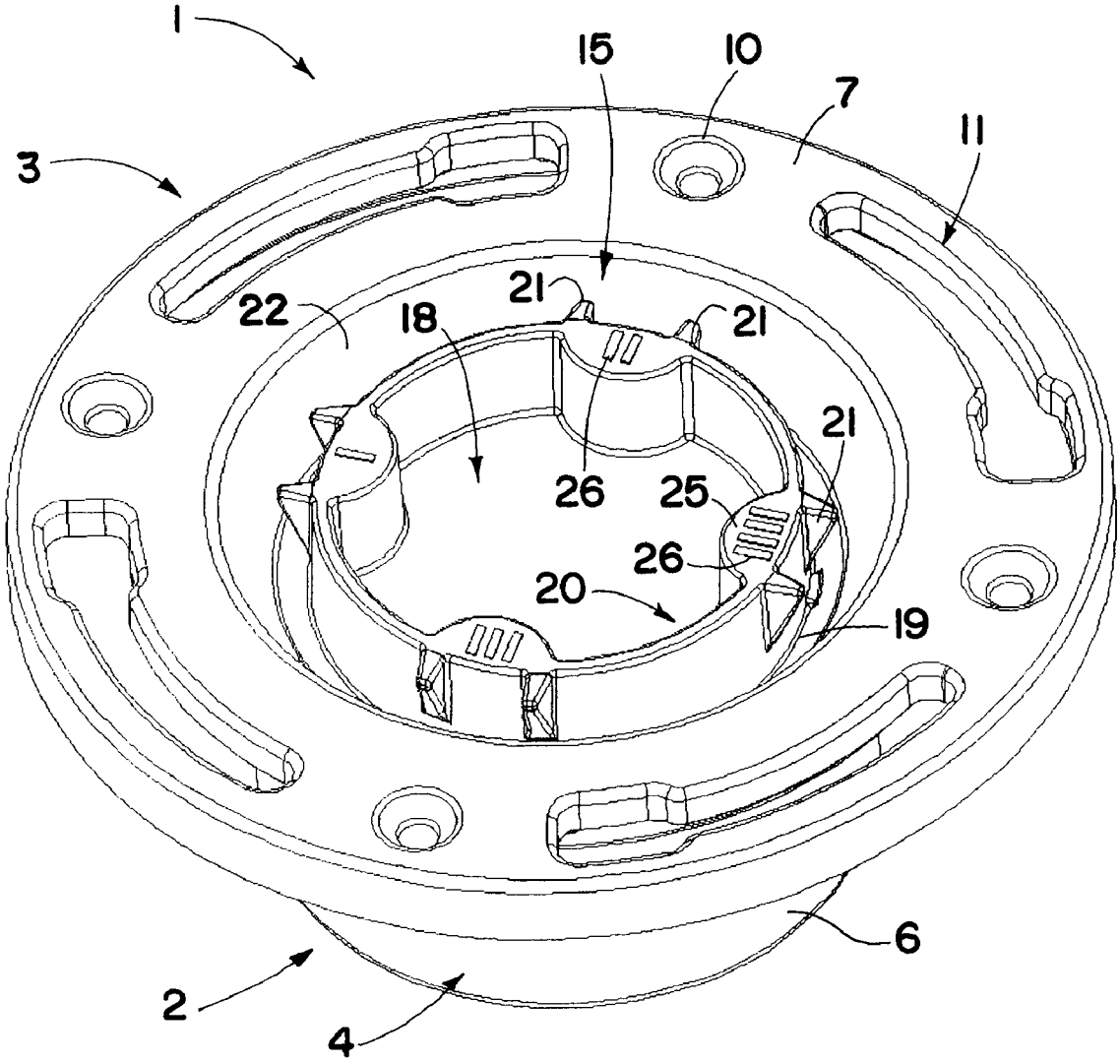
FIG. 1 is a top perspective view of one form of closet flange of the present invention.
Figure 2:
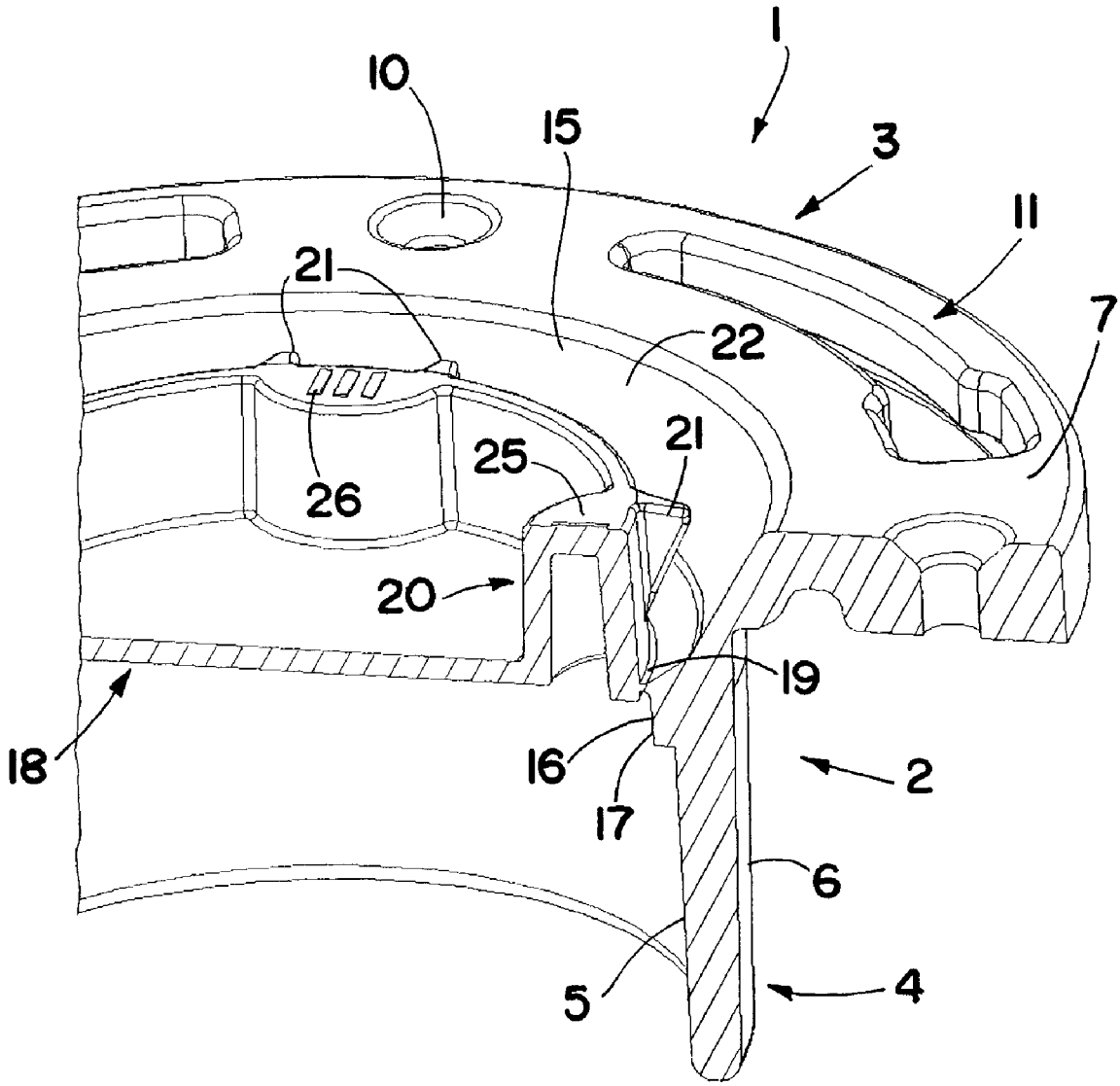
FIG. 2 is a fragmentary perspective view of the closet flange of FIG. 1.
Figure 3:
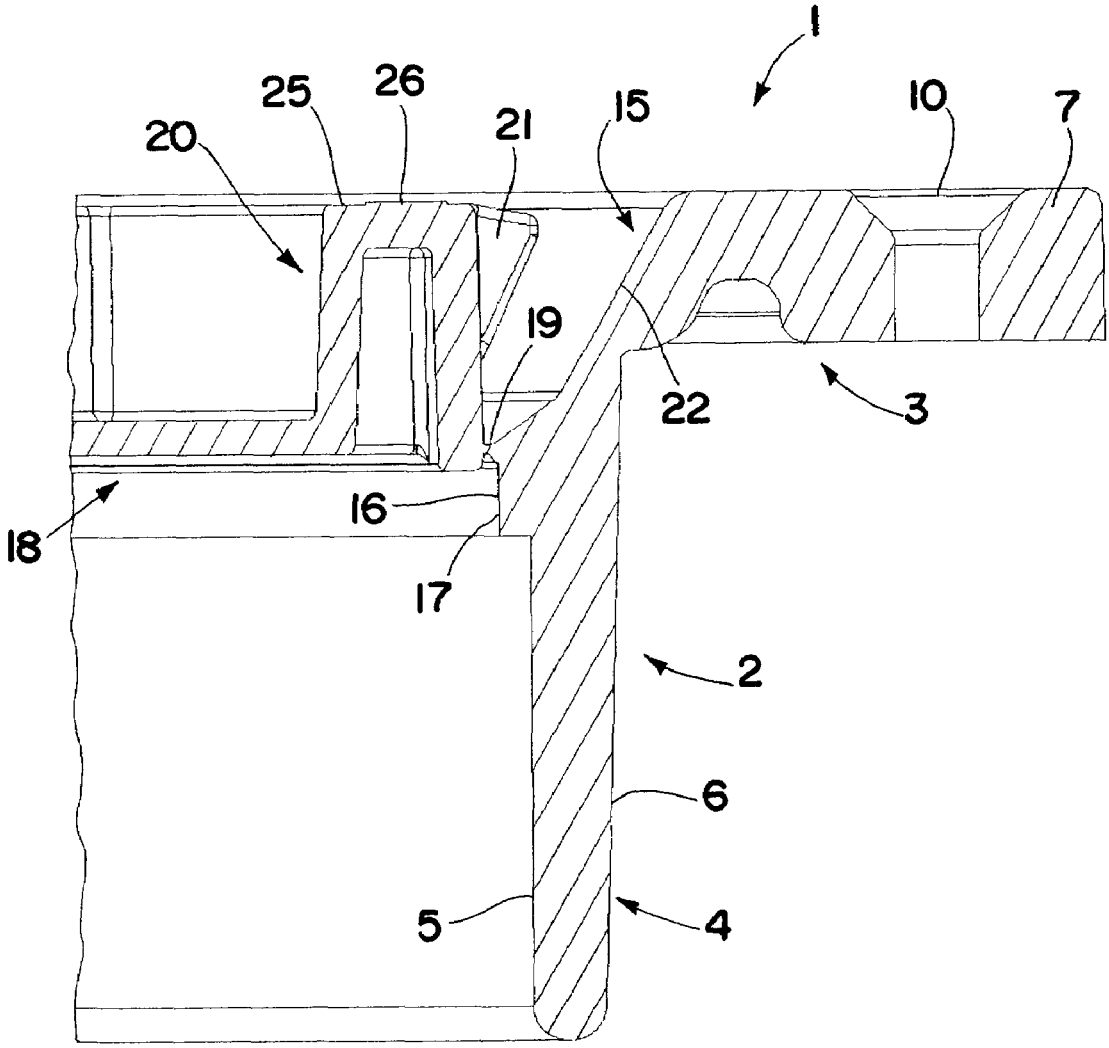
FIG. 3 is a fragmentary vertical section through the closet flange of FIG. 1.

Referring to the drawings, wherein like reference numerals are used to designate like parts, there is shown one form of closet flange 1 in accordance with the present invention which comprises a body 2 having a larger diameter upper body portion 3 and a smaller diameter lower body portion 4. Lower body portion 4 has an inside bore 5 (see FIGS. 2 and 3) and an outside diameter 6, both of which may be solvent weldable (if made of plastic) or otherwise connectable to a drain pipe of a plumbing system (not shown). An attachment flange 7 extends radially outward from the upper body portion 3 providing a means of anchoring the closet flange both to the toilet and to the floor.

Attachment flange 7 is shown integral with upper body portion 3. However, the attachment flange may be a separate piece that is circumferentially movable relative to the upper body portion if desired. A plurality of recessed holes 10 may be provided in attachment flange 7 for mechanically mounting the closet flange to the floor (not shown). The toilet (not shown) may be mounted to the attachment flange through a plurality of keyed slots 11 that are larger at one end to accept bolt heads and undercut at the opposite end to anchor the bolt heads as the bolts are tightened.

Upper body portion 3 may have a larger diameter inlet opening 15 that tapers inwardly and communicates with bore 5 which may have a stop shoulder 16 adjacent the upper end thereof. At the intersection of inlet opening 15 with bore 5 (including stop shoulder 16) is a recessed knockout 18 that may be connected to the interior wall 17 of bore 5 by a frangible seam 19 for ease of removal of the knockout. The recessed nature of knockout 18 within the body helps prevent accidental damage to or premature removal of the knockout during construction.

To prevent knockout 18 from accidentally passing all the way through the bore as it is being broken out of bore 5 (including stop shoulder 16), one or more vertical uprights 20 extend axially upwardly from the knockout within inlet opening 15 to provide support for one or more protrusions 21 that extend radially outwardly beyond bore 5 in spaced non-contactinci relation from the interior wall 22 of inlet opening 15. In the drawings, the vertical upright 20 is shown as being annular, and has a plurality of pairs of circumferentially spaced protrusions 21 extending radially outwardly therefrom to prevent the knockout from passing through the bore. Also the protrusions 21 are shown as having tapers similar to the taper of the inlet opening 15. However, it will be appreciated that instead of providing a single annular upright, a plurality of circumferentially spaced uprights may be provided. Also the shapes of the uprights and protrusions may be varied as desired.

To aid in breaking knockout 18 out of the bore, the vertical upright or uprights 20 may have one or more raised enlarged flat surface areas 25 within the inlet opening 15 for ease of striking by a hammer. In the embodiment shown in the drawings, four such raised enlarged flat surface areas 25 are shown circumferentially spaced from each other around the periphery of the knockout. Also suitable indicia 26 such as different numbers of lines or numerals may be provided on the flat surface areas 25 as an indication that the surface areas should desirably be hit sequentially around the periphery of the knockout to aid in its removal.

The stop 16 within bore 5 may act as a pipe stop for locating the end of a drain pipe (not shown) within bore 5 which may be dimensioned to insure a satisfactory interference with the drain pipe during solvent welding of the drain pipe within the bore when the closet flange 1 and drain pipe are made of a suitable plastic material, as well known in the art. Alternatively, a larger diameter drain pipe (also not shown) appropriately dimensioned to insure a satisfactory interference with the outside diameter 6 of lower body portion 4 may be inserted over the outer end of the lower body portion and solvent welded in place.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been disclosed with respect to only one embodiment, such feature may be combined with one or more other features as may be desired and advantageous for any given or particular application.

What is claimed is:

1. A closet flange comprising a body having a lower body portion containing a bore and an upper body portion containing an inlet opening communicating with the bore, at least a portion of the inlet opening having a larger diameter than the bore, and a knockout recessed within the body for closing off the bore, the knockout having a frangible connection with an interior wall of the bore to permit the knockout to be broken out of the bore, and one or more protrusions extending vertically from the knockout and radially outwardly from the knockout beyond the frangible connection into the inlet opening to permit the knockout to be broken out of the bore while preventing the knockout from passing all the way through the bore.

2. The closet flange of claim 1 wherein the one or more protrusions extend radially outwardly from the knockout in non-contacting relation from an interior wall of the inlet opening.

3. The closet flange of claim 2 wherein the inlet opening tapers inwardly toward the bore, and the one or more protrusions are similarly tapered for engaging an interior wall of the inlet opening after the knockout has been broken out of the bore to prevent the knockout from passing all the way through the bore.

4. The closet flange of claim 1 wherein the bore includes a stop shoulder adjacent an upper end of the bore.

5. The closet flange of claim 4 wherein the frangible connection is with the stop shoulder.

6. The closet flange of claim 1 wherein the knockout has at least one raised enlarged flat surface area means within the inlet opening for striking by a tool to aid in breaking the knockout out of the bore.

7. The closet flange of claim 6 wherein the knockout has a plurality of circumferentially spaced enlarged flat surface area means for striking by a tool to aid in breaking the knockout out of the bore.

8. The closet flange of claim 7 wherein the flat surface area means have indicia means thereon for indicating a sequence for striking the flat surface area means to aid in removal of the knockout from the closet flange.

9. The closet flange of claim 8 wherein the indicia means comprises different numbers of lines or numerals on different ones of the flat surface area means for indicating a sequence for striking the flat surface area means.

10. A closet flange comprising a body having a lower body portion containing a bore and an upper body portion containing an inlet opening communicating with the bore, at least a portion of the inlet opening having a larger diameter than the bore, and a knockout recessed within the body for closing off the bore, the knockout having a frangible connection with an interior wall of the bore to permit the knockout to be broken out of the bore, and at least one vertical upright extending axially upwardly from the knockout within the inlet opening, the vertical upright having at least one protrusion that extends radially outwardly beyond the bore in non-contacting relation from an interior wall of the inlet opening to permit the knockout to be broken out of the bore while preventing the knockout from passing all the way through the bore.

11. The closet flange of claim 10 wherein the bore includes a stop shoulder adjacent an upper end of the bore, and the frangible connection is with the stop shoulder.

12. The closet flange of claim 10 wherein the knockout has at least one raised enlarged flat surface area within the inlet opening for striking by a tool to aid in breaking the knockout out of the bore.

13. The closet flange of claim 12 wherein the knockout has a plurality of circumferentially spaced enlarged flat surface areas for striking by a tool to aid in breaking the knockout out of the bore.

14. The closet flange of claim 13 wherein the flat surface areas have different indicia for indicating a sequence for striking the flat surface areas to aid in removal of the knockout.

15. The closet flange of claim 14 wherein the indicia comprises different numbers of lines or different numerals on different ones of the flat surface areas for indicating a sequence for striking the flat surface areas.

16. The closet flange of claim 10 wherein the at least one vertical upright has a plurality of circumferentially spaced protrusions extending radially outwardly beyond the bore in spaced relation from the interior wall of the inlet opening.

17. The closet flange of claim 16 wherein the inlet opening tapers inwardly, and the protrusions on the vertical upright are similarly tapered for engaging the interior wall of the inlet opening after the knockout has been broken out of the bore to prevent the knockout from passing all the way through the bore.

18. A closet flange comprising a body having a lower body portion containing a bore and an upper body portion containing an inlet opening communicating with the bore, at least a portion of the inlet opening having a larger diameter than the bore, and a knockout recessed within the body for closing off the bore, the knockout having a frangible connection with an interior wall of the body to permit the knockout to be broken out of the body, the knockout having one or more portions that extend vertically and radially outwardly beyond the frangible connection into the larger diameter portion of the inlet opening in non-contacting relation from an interior wall of the inlet opening to permit the knockout to be broken out of the bore while preventing the knockout from passing all the way through the bore.

19. A closet flange comprising a body having a lower body portion containing a bore and an upper body portion containing an inlet opening communicating with the bore, at least a portion of the inlet opening having a larger diameter than the bore, and a knockout recessed within the body for closing off the bore, the knockout having a frangible connection with an interior wall of the bore to permit the knockout to be broken out of the bore, and a plurality of circumferentially spaced protrusions extending vertiaclly from the knockout and radially outwardly from the knockout beyond the bore into the inlet opening to permit the knockout to be broken out of the bore while preventing the knockout from passing all the way through the bore.

20. A closet flange comprising a body having a lower body portion containing a bore and an upper body portion containing an inlet opening communicating with the bore, at least a portion of the inlet opening having a larger diameter than the bore, and a knockout recessed within the body for closing off the bore, the knockout having a frangible connection with an interior wall of the bore to permit the knockout to be broken out of the bore, and one or more protrusions extending radially outwardly from the knockout beyond the bore into the inlet opening to permit the knockout to be broken out of the bore while preventing the knockout from passing all the way through the bore, wherein the one or more protrusions extend radially outwardly from at least one vertical upright extending axially upwardly from the knockout within the inlet opening.

* * * * *